United States Patent [19]

Mickeler et al.

[11] 3,975,927

[45] Aug. 24, 1976

[54] STRIPING APPARATUS FOR CIRCULAR KNITTING MACHINES

[75] Inventors: Karl Mickeler, Rottenburg; Moritz Schall, Wurmlingen, both of Germany

[73] Assignee: Firma Fouquet-Werke Frauz & Planck, Rottenburg, Germany

[22] Filed: Jan. 30, 1974

[21] Appl. No.: 437,893

Related U.S. Application Data

[63] Continuation-in-part of Ser. No. 141,278, May 7, 1971.

[30] Foreign Application Priority Data

May 19, 1970 Germany .....2024241

[52] U.S. Cl. ..... 66/134; 66/19; 66/131; 66/138

[51] Int. Cl.[2] ..... D04B 15/60

[58] Field of Search ..... 66/19, 125 B, 131, 133, 66/134, 138

[56] References Cited

UNITED STATES PATENTS

| | | | |
|---|---|---|---|
| 539,649 | 5/1895 | Scott | 66/19 X |
| 716,767 | 12/1902 | Scott | 66/19 X |
| 1,129,261 | 2/1915 | Wilcomb | 66/134 X |
| 1,523,496 | 1/1925 | Simek | 66/138 |
| 2,448,498 | 8/1948 | Shortland | 66/134 |
| 3,256,715 | 6/1966 | Monday | 66/133 X |
| 3,298,203 | 1/1967 | Schmidt et al. | 66/131 |
| 3,452,559 | 7/1969 | Paepke | 66/19 |

FOREIGN PATENTS OR APPLICATIONS

| | | | |
|---|---|---|---|
| 1,056,189 | 10/1953 | France | 66/131 |
| 1,340,280 | 9/1963 | France | 66/131 |
| 262,241 | 12/1926 | United Kingdom | 66/131 |

*Primary Examiner*—Mervin Stein
*Assistant Examiner*—Andrew M. Falik
*Attorney, Agent, or Firm*—Flynn and Frishauf

[57] ABSTRACT

A circular knitting machine having a thread guide fixed to the machine is formed with a thread insertion slot, and a plurality of thread guiding eyes holding threads for insertion. A thread entrainment element is located below the thread guide, travelling synchronously with the progression of movement of the needles between idle and knitting position. The thread entrainment element has a segment projecting radially under the thread guide means, and formed with an inwardly, rearwardly inclined guide surface to entrain and insert threads held by the eyes on the thread guide means into the thread insertion slot when the respective eyes are in working position. A thread directing portion, of essentially triangular shape is located in advance, with respect to its direction of movement, of the guide surface to define a guide slot which terminates in any oblong opening adjacent the junction line of the base of the element and of the segment, forming a nip, to separate newly inserted, and previously knitted yarns at the index line.

15 Claims, 9 Drawing Figures

Fig. 2
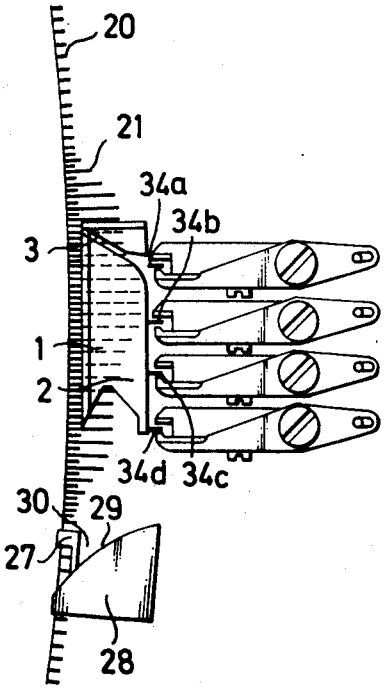
Fig. 4
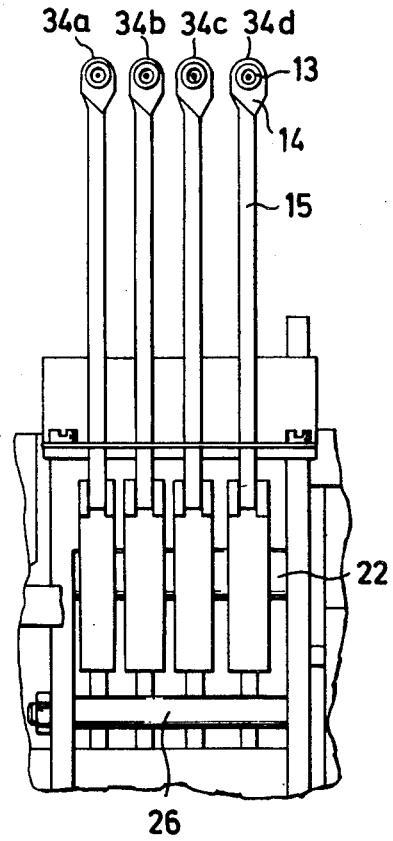
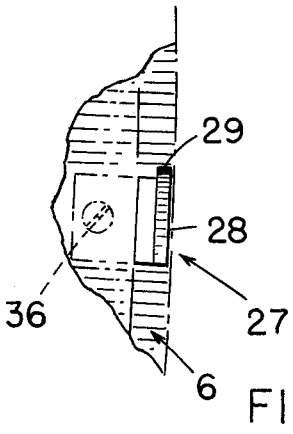
FIG. 2a

STRIPING APPARATUS FOR CIRCULAR KNITTING MACHINES

This application is a continuation-in-part of application Ser. No. 141,278, filed May 7, 1971.

The present invention relates to a stripping apparatus for circular knitting machines, and more particularly to circular knitting machines in which threads can be inserted, selectively, by means of a thread guide member to the knitting position.

Upon change of threads in circular knitting machines, the various threads must be supplied at positions on the machine which are as close to each other as possible, along the circumference of the machine, so that the change-over points on the fabric to be made are as small as possible. The change-over points are frequently removed from the finished fabric; if they are extensive, then too much fabric must be discarded for economic operation. In fabric which can be sold as "irregular", that is, in fabric in which the change-over points can remain, the defects should be as small and as inconspicuous as possible.

It has previously been proposed — see German Pat. No. 964,801 — to provide a thread guide member for a striping apparatus on circular knitting machines, which is fixed and located immediately in advance of the vertical, or the horizontal needles, respectively, and which forms in horizontal, or vertical plan view, respectively, a general V-shape, the apex of the V, that is, its narrowest point, being roughly in the middle of the associated adjacent thread grippers. The thread changing arrangement for such an apparatus utilizes fixed, or radially movable eyes, one for each thread, and a gripper which is movable in a radial plane. The adjacent grippers themselves are movable in different, adjacent planes. This arrangement which permits the change-over positions in the fabric to be small, requires, however, that the thread to be inserted is gripped at both sides and is moved centrally by the thread guide member. Moving a thread by means of a sliding surface of this type increases the tension arising in the thread, which undesirably affects the fabric being made.

It has also been proposed to provide bails or the like, cooperating with thread guide members having, for example, a plurality, such as three insertion slots. This arrangement additionally utilizes notches or reliefs in the cylinder cam elements. A thread guide with a plurality of insertion slots cannot operate to provide goods having a width of the change-over point which is reducible below a certain minimum, since the distance of the insertion slots themselves cannot be decreased below a certain limit and, usually, is comparatively great. Additionally, difficulties arise due to increase in thread tension. The manufacture of such bails is comparatively costly.

It has also been proposed (see U.S. Pat. No. 3,452,559) to provide a circular knitting machine with a striping apparatus for a plurality of colors by utilizing adjacently located thread guides and to remove a dial needle at at least one point of the dial and insert, instead, a catch hook which, by utilizing a guide jack, is extended in horizontal direction. Its movement is controlled by additional cam elements and it must be retracted each time at the cast-off position, requiring additional structural elements in the machine.

It is an object of the present invention to provide a striping apparatus for circular knitting machines, which is simple in construction, results in knitted fabric which has small change-over points and in which variations in thread tensions can be avoided.

Subject Matter of the Present Invention

Briefly, a thread entrainment element is located below a fixed thread guide means, operating synchronously with the progression of movement of the needles between withdrawn and knitting positions. The thread entrainment element has a thread entrainment segment which projects radially under the thread guide and is formed with a guide surface at the leading side thereof (with respect to machine operation) and which entrains and inserts the respective threads from the thread guide means into a thread insertion slot, the respective threads being supplied by thread guiding eyes which, preferably, are movable between a working and a rest position.

The thread guide element can, preferably, be secured to the needle cylinder, so that the thread entrainment segment will be at a level below the dial needles when they project. The arrangement may, however, also be made such that the thread guide element is secured to the dial and extends immediately adjacent to the cylinder needles as they project during the knitting operation.

The threads to be inserted must be prevented from crossing over, and must be kept in proper distance and it is therefore desirable to locate thread guiding bails above the thread guide and beneath the thread guiding eyes, in order to properly orient and separate the various threads from eacn other. These thread guide bails may be shaped as polygonal wire frames, or the like, which are interconnected by a transversely extending pin or rod, located at a suitable distance from the thread guide element and the guiding portions of the bails, and which direct the threads passing through thread guiding eyes when in working position. The individual thread, or, respectively, the individual threads can be held by the associated thread guiding eyes in a rest, or hold position until they are inserted by the thread entrainment segment into the insertion slot of the thread guide itself. To ensure reliable insertion of the threads, it is desirable to shape the leading surface of the thread guide segment such that it forms, with the surrounding surface of the dial, or the facing end surface of the cylinder, a decreasing open angle into which the threads are inserted when the segment passes by.

The striping apparatus is simple, and is particularly adapted for machines having two progressions of movement of the needles projecting from the cylinder, and dial, respectively, although it can be used with machines in which only one of the needle groups is progressively projecting. It can be used for various types of fabrics and to accomplish various tasks, for example to change threads being supplied to one or more knitting positions, to insert reinforcement threads, separating threads, or the like.

In accordance with a feature of the invention, the thread entrainment element is an essentially angled structure in which the thread guide surface is an inwardly inclined slit, so that the structure is sub-divided along one of the angled sides to form, at the trailing side (with respect to machine operation) the thread entainment segment proper and ahead of the slit, a thread directing triangle. An elongated opening is formed at the termination of the slit. This slit, and the thread directing triangle are particularly useful when certain types of yarns are to be knitted, for example yarns of synthetic fibers, or yarns which have a tendency to stretch. The thread entrainment segment, oblong slit, the directing cooperate to separate the yarn being newly inserted, and the yarn being cut off, upon thread insertion by the striping apparatus in such a way that the needles which knit the newly inserted yarn at the index line will not catch the tail of yarn previously knitted, or an excess forward end of yarn being inserted, so that the free, loose ends of the yarn cannot be interknitted with the remainder of the fabric. The fabric tube, therefore, will have, at the index line, loosely hanging yarn fringes. These yarn fringes, not being interknitted, result in a considerably smaller region at which the yarn changes over, thus in less waste at the index line, upon severing of the tube knitted by the circular knitting machine. A further advantage is that the threads, hanging loose, will not form a thickened welt of material at the index line. As the fabric, after having been knitted, is pulled off the knitting machine, the tube is collapsed for take-up on a take-up roll. Upon collapse, a knitted-in welt forms a thickened region interfering with smooth rolling of the tube on a wind-up roll. Leaving the yarn ends free, not interknitted with the remainder of the fabric, permits flattening of the tube without formation of a thickened knitted ridge of the roll-up tube.

The invention will be described by way of example with reference to the accompanying drawings, wherein:

FIG. 2 is a schematic top view of the thread entrainment element and the thread holding and sliding arrangement with the thread entrainment element secured to the cylinder;

Figure 1:
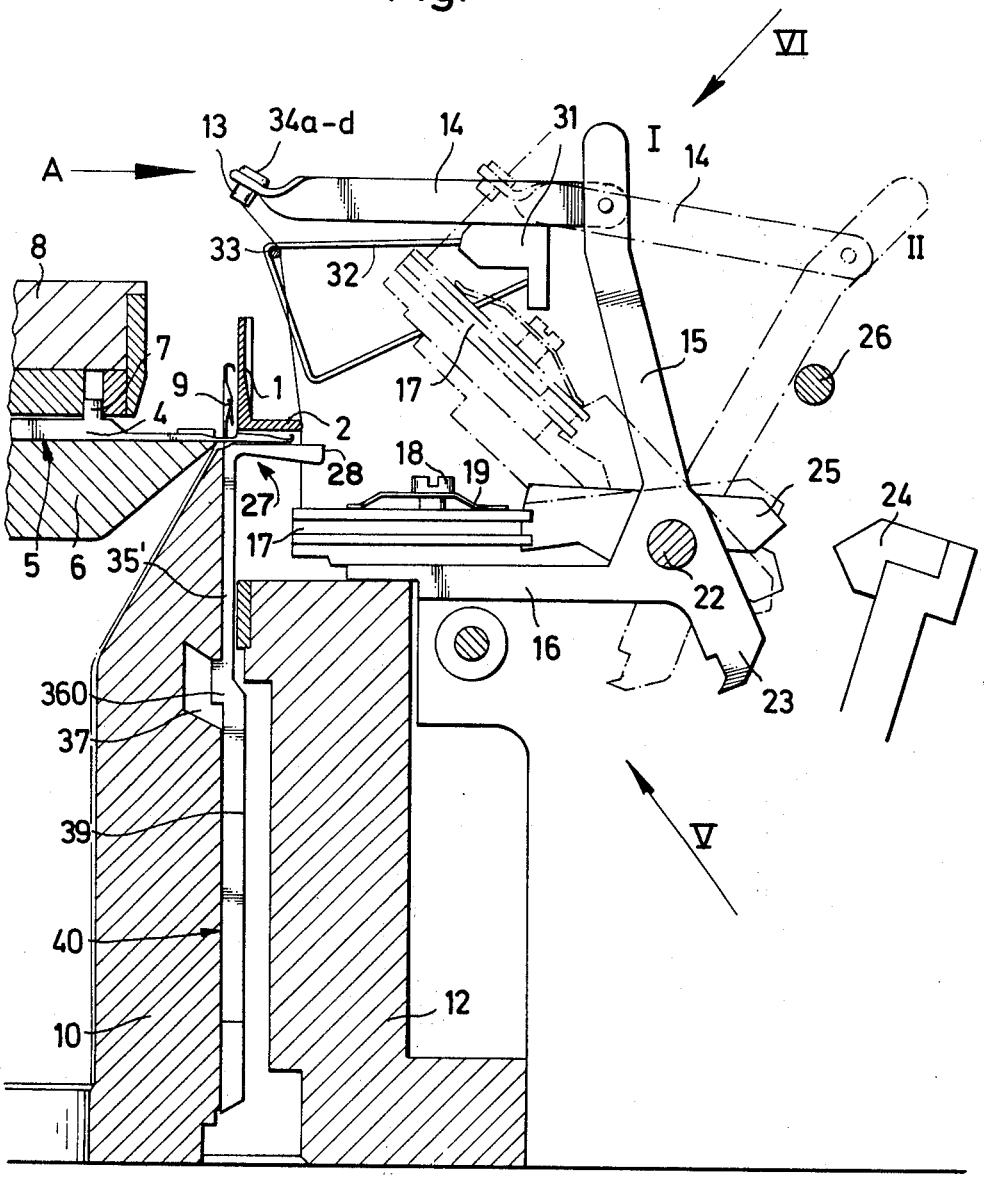
FIG. 1 is a side view of the apparatus, highly schematic, and partly in section, with a fragmentary illustration of the cylinder and the cylinder housing and the associated cam, as well as a fragmentary view of the dial cam and cam race housing, for a circular knitting machine.
Figure 3:
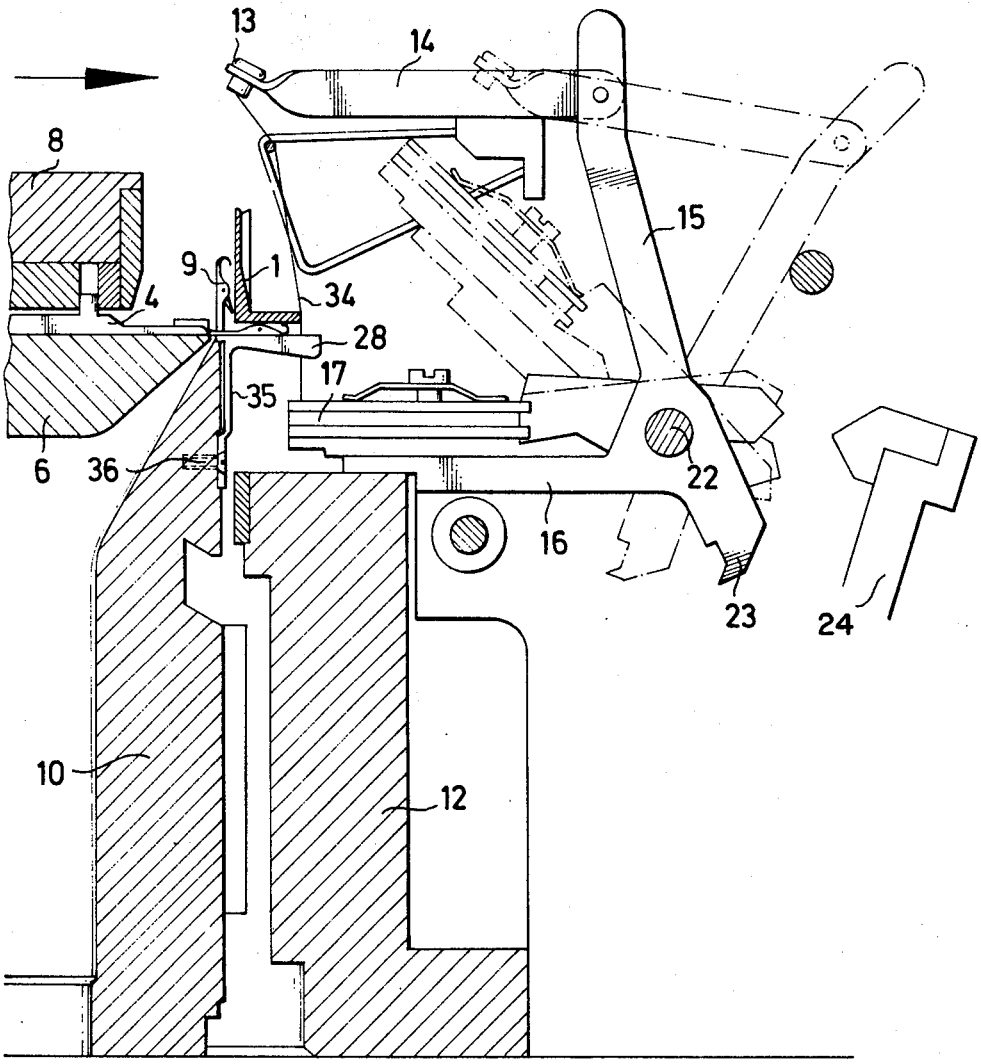
Figure 5:
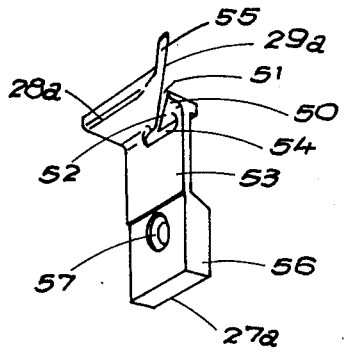
Figure 6:
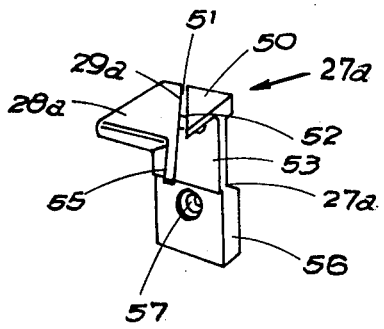

FIG. 2*a* is a fragmentary schematic top view of the thread entrainment element when secured to the dial;

FIG. 3 is a view similar to FIG. 1, illustrating a different embodiment of the present invention;

FIG. 4 is a fragmentary view in the direction of the arrow A of FIGS. 1 and 3;

FIG. 5 is a perspective view from the bottom forward, taken along arrow V of FIG. 1, of a thread insertion element having a thread directing surface;

FIG. 6 is a perspective view taken from the top right, in the direction of the arrow VI of FIG. 1 of the element of FIG. 5.

Figure 7:
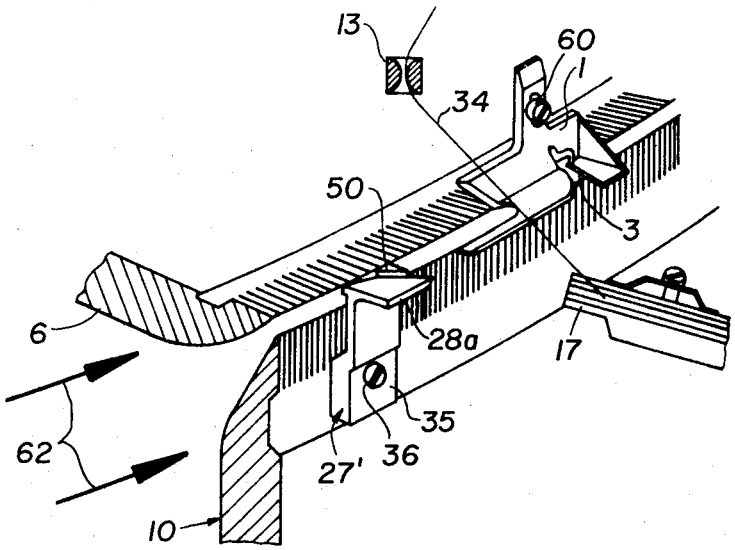
Figure 8:
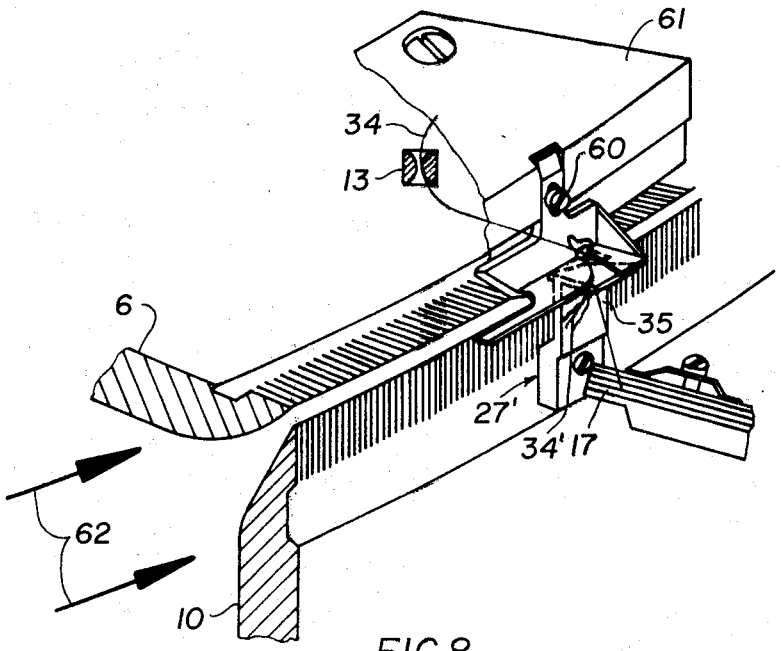

FIG. 7 is a highly schematic perspective view, partly in section, of the cylinder and dial end portions of a circular knitting machine, illustrating the position of the thread entrainment element, secured to the cylinder, just in advance of the insertion step, with a single thread being held in insertion position; and FIG. 8 is a view similar to FIG. 7, also showing a fragmentary portion of the dial housing structure, the position of the thread entrainment element having moved to the point just when insertion is taking place.

The present invention is adapted to be used with circular knitting machines, shown in the drawings in a fragmentary, partly schematic view only. The knitting machine, as is customary, at the knitting position has a thread guide 1 which, as is customary, is secured to the dial cam, or dial cam housing, in a suitable manner and as well known. The thread guide 1 has a thread guiding plate 2, which extends radially beyond the region of the dial needles, in their projecting motion, as the needles pass through the dial cam, projecting beyond the dial needle bed during knitting. This progressive movement of the needles between idle and knitting position is indicated by the difference in length of the needles for examaple as at 20, 21, and may be termed knitting position contour. The thread guide 1 is fixed, and not movable. Its manner of attachment to the dial is well known. FIG. 8 shows attachment by means of screw 60 to the housing or wowling 61 over the dial. The thread guide plate 2 has an inclined thread guiding notch 3 formed therein which terminates at the rearward corner of the thread guide 1, as best seen in FIGS. 2 and 3. The dial needle contour, that is, its progression of the needles as they move along the dial needle bed is formed by dial needles 4, which are located in the dial needle bed 5 of dial 6, held for sliding movement back and forth, that is right to left in FIG. 1. The dial needles 4 are moved by means of butts 7 which enter the cam races of the cam structure 8.

The cylinder needle contour is formed by cylinder needles 9 which, as customary, are guided in the needle cylinder 10, which has an oppositely located associated cam housing 12. Dial 6 and needle cylinder 10 rotate in the circular knitting machine, in counter-clockwise direction with respect to FIG. 2 as seen by arrows 62, FIGS. 7 and 8; the cam structure 8 and the cylinder housing 12 are fixed to the machine.

The striping apparatus is located in the region of the knitting zone, that is, where the needles are caused to knit. The apparatus as illustrated is arranged to permit the use of four different colors, and thus is formed with four adjacent thread guide eyes 13, each one located within a thread insertion arm 14. Thread insertion arm 14 is movable between the solid-line position (FIG. 1) and the chain-dotted position. The solid-line position is the working, or operating position; when the guide eyes are switched to the chain-dotted position, they are moved radially. The arms 14 are coupled with the swing lever 15 which has an arm extension 16 on which a thread clamping arrangement 17 is secured. The thread clamp 17 is adjustable by means of a screw 18 bearing against a pressure spring 19. The lever 15 can pivot over a shaft 22, secured to the machine. Pivoting movement is controlled by a switching mechanism, not shown in detail, and known, which can engage a projection on lever 15 formed with a catch end 23. The switching mechanism is schematically indicated by element 24 which, in one form, when bearing down against the catch end 23, will swing the lever 15 outwardly to the chain-dotted position. Other levers, not shown, can restore the apparatus back to the full-line position shown in FIG. 1. Scissor or cutting levers 25 are located between levers 15, also operated by the control mechanism 24, the scissor arms cutting thread held by the clamp 17 after the thread has been inserted, as known.

The rest, or withdrawn position of the thread guide eyes is determined by a fixed rod, or back-up member 26, secured to the machine, against which the levers 15 can bear. The two positions of the thread eyes are indicated at I, for the working position, and II for the withdrawn or rest position.

A thread entrainment element 27 is located below the fixed thread guide plate 2. The thread entrainment element 27 is formed with a segment 28, radially projecting beyond the thread guide plate 2 of the thread guide 1. The segment is formed with a guide surface 29 arranged at the leading edge thereof. Guide surface 29, with the segment 28 forms together with the circumference of the dial 6 a decreasing, open funnel-shaped space 30 (FIG. 2), which may be termed a pinch, or nip space. Thread guide bails 32, or hoops, polygonally shaped and made, for example of wire, are located above the thread guide, secured to a bracket 31 fixed to the machine. Each one of the hoops or thread guide bails 32 is associated with one of the thread guiding eyes 13. The polygonal wire hoops are vertically arranged and interconnected at the side facing the thread guide 1 by a transverse rod 33, over which the thread may run, the various threads being separated from each other by the thread guide hoops.

The threads 34*a* to 34*d*, derived from thread spools (not shown) are passed through eyes 13 and are held with their ends in the clamping device 17. If one or more threads are to be inserted, the respective thead guiding eyes 13 are switched by the switching mechanism 24 into the full-line position of FIG. 1. The threads, held in a rest or waiting position, are separated from each other by bails 32. The guide surface 29 formed on segment 28 of the thread entrainment element 27 catches the waiting threads, which are projected along the outline of the thread guide plate 2 so that they can be inserted into the thread insertion slot 3, for insertion of the threads.

The thread entrainment element 27 is formed with an elongated base 35 which is angularly interconnected with segment 28. The base 35 secures the element in position. As seen in FIG. 3, the base 35 is short, and secured by means of a screw 36 to the needle cylinder 10. The embodiment of FIG. 1 illustrates a base portion 35', which is elongated and is formed with a projection 360 which engages in a groove 37 in the needle cylinder 10. The extension 39 of the base extends into the region of the needle bed 40 of the cylinder 10.

It is, of course, also possible to secure the thread entrainment element 27 to the dial 6, so that the segment 28 will extend in immediate vicinity of the dial needle contour 20.

The alternate construction in which the thread entrainment element 27 is secured to dial 6 is illustrated, in fragmentary form, in FIG. 2*a*, which is a fragmentary plan view illustration of that portion of FIG. 1 necessary to an understanding of the invention.

Operation, with specific reference to FIGS. 7 and 8: A thead entrainment element 27', which is similar to element 27*a* (FIGS. 5, 6) but without the projecting extension 55 thereof, rotates with the cylinder 10. The difference between thread entrainment element 27' and the element 27, so far described, essentially consists in the presence of a leading directing portion 50 (FIGS. 5, 6) located in advance of the guide segment 28*a*, which has a straight edge rather than the curved edge 29 shown in FIG. 2. Operation of the elements 27, 27' and 27*a* is similar. Preparatory to inserting a thread, the striping mechanism is brought into the full line position of FIG. 2. One or more threads 34 will, therefore, be in the path of movement of the element 27'. As the element 27', together with the dial and the cylinder 6, 10, move towards the thread 34, the leading edge 29*a* of element 27' will catch the thread, slide it along the outer edge of blade 2 of thread guide 1, until the thread catches in the notch 3, being pushed therein by the guide edge 29*a*, as best seen in FIG. 8, where the thread entrainment element 27' has reached the position of insertion. The threads, already cut, but held in the clamp 17 are pulled towards the outside of the downwardly extending plate 35 of the thread entrainment element. FIG. 8 shows, schematically, loose threads 34', cut and dangling outside of base 35. These threads will, therefore, not be interknitted upon subsequent knitting operation.

Embodiment of FIGS. 5 and 6: The thread entrainment element 27*a* has the thread guide segment 28*a*, and a leading or forwardly (with respect to machine operation) located thread directing portion 50. The thread directing portion 50 has a side edge 52 which, together with the guide surface 29*a* of the thread entrainment segment 28*a*, forms a slit 51. Slit 51 is open at both sides, that is, is open at the outer end and at the inner side terminates in an elongated opening 54 (FIG. 5). The leading edge 29*a* of the guide segment 28*a*, as well as the edge 52 of the directing portion 50 defining the slit can be straight (FIGS. 5, 6), or may be curved as illustrated in connection with FIG. 1, where only the guide surface 29 is shown. Slit 51, in any event, extends in an inwardly inclined (with respect to the knitting position of the knitting needles) direction. If the element is mounted on the cylinder of the machine, it extends, therefore, inwardly with respect to machine center; if mounted on the dial, it extends downwardly towards the cylinder, that is, at an inclination with respect to the circumferential surface of the respective needle bed, that is, the cylinder 10, or the dial 6.

The directing portion 50, as well as the entrainment segment 28*a* are unitary portions of an angle structure, and thus unitary with a flange or angle portion 53. The flange or angle portion 53 extends at a right angle, or approximately so, with respect to the thread entrainment segment 28*a* and the directing portion 50. The opening 54 is formed in the flange portion 53 just beneath the slit 51 (FIG. 5), in communication with the slit 51, and extends on both sides of the terminal end of slit 51, that is, at its intersection with the spex of the angle. The longitudinal axis of the elongated opening 54 is approximately horizontal, that is, essentially parallel to the upper surface of the thread entrainment segment 28*a* and the thread directing portion 50. The length of the longitudinal, elongated opening 54 is so selected that it extends beneath both the thread entrainment segment 28*a* and the thread directing portion 50.

The thread entrainment segment 28*a* is formed, or has attached thereto, a projecting extension 55, in the form of a projecting needle, or pin. It projects from the side of the segment 28*a* remote from the respective needle bed, that is, cylinder 10, or dial 6, respectively, and is so arranged that an edge thereof forms a continuation of the guide surface 29*a*. The projection 55 may be unitary with the segment 28*a*; in a preferred form, however, it is a separate pin which is merely soft-soldered to the segement 28*a*.

The angled portion 53 is extended to form an attachment base 56, through which a hole 57 extends to secure the element 27*a* by means of a screw, similar to screw 36 (FIG. 3) to the respective needle bed, for example to the cylinder 10 (FIG. 3) or to the dial 6 (FIG. 2*a*).

The thread directing portion 50 is approximately triangular, in plan view; it extends over the angled portion 53 like a projecting roof, or guard, as clearly seen in FIGS. 5 and 6.

Operation: In essence, the thread entrainment element 27*a* of FIGS. 5 and 6 operates similarly to element 27, explained in detail in connection with FIGS. 1–4. The thread directing portion 50, additionally, guides newly inserted thread or yarn between the edge 52, and together with the surface 29*a*, so that the yarn will be positively guided by the slit 51. Due to the projecting form of the thread directing portion 50, that is, extending over the angled portion 53, the ends of the newly inserted threads are cleanly held in a downwardly extended direction. The elongated hole 54 ensures that the ends of the yarn, together with the fabric being knitted, can be neatly and cleanly directed and pulled over the upper edge of the needle cylinder.

The needle or pin-like extension or projection 55 extends the guide surface 29*a* radially outwardly. This improves the reliability of insertion of newly inserted yarn in the slit 51. Some portions of the thread insertion mechanism, for example the thread insertion arms 14 or the thread holding device 17 (FIG. 1) may jam, or catch. The thread entrainment element of FIGS. 5, 6 permits decreasing the radial extent of the thread guide segment 28*a* and, rather, merely having the projecting pin 55 provide for additional radial projection to catch newly inserted thread. Damage to the thread insertion devices 14, 17, or others, which may have jammed, is avoided, since the pin 55 can be made to be rather thin and fragile, so that it can bend at the connecting junction with the thread entrainment segment 28*a*. If the pin is separate from the thread entrainment element, for example merely soldered, then the pin may bend, or completely break. A soldered pin can readily be resoldered, thus permitting rapid and simple repair, without disassembly of any portions of the knitting machine, since the segment is readily accessible at the circumference. Permitting the pin 55 to bend, or to be severed at a solder junction avoids damage to any other portions of the striping apparatus. After clearing any defects in the remainder of the striping apparatus, the extending projection 55 is merely re-soldered in its proper position.

Various changes and modifications may be made within the scope of the inventive concept.

We claim:

1. In a circular knitting machine having a dial needle bed (6) and a cylinder needle bed (10), dial needles (4) and cylinder needles (9) in said respective needle beds, and means projecting the respective needles in accordance with predetermined contours;

striping apparatus including a plurality of thread guiding eyes (13) and means (14, 15) mounting said eyes on the machine for movement between a rest position and a working position, individual threads (34*a*–34*d*) being guided to the thread guide means by the eyes (13);

thread guide means (1) fixed on the machine and formed with a thread insertion slot (3);

and a unitary thread entrainment element (27, 27*a*) located below the thread guide means (1), fixedly secured to one of said beds and travelling circumferentially of the machine synchronously with the progression of movement (20, 21) of the needles between withdrawn and knitting positions, to entrain and insert into the thread insertion slot (3) of the thread guide means one or more threads (34*a–d*) supplied by those thread guide eyes (13) which are in working position;

said thread entrainment element comprising a thread entrainment segment (28, 28*a*) radially projecting under the thread guide means (1), said segment being formed with an inwardly directed inclined forward guide surface (29, 29*a*) to form a nip (30) with the respective one of said beds which, upon rotation of said respective bed, comes into alignment with said thread insertion slot, the thread entrainment segment (28) being located on the respective bed and extending to the region adjacent to the respective needle contour of the other respective bed, to which it is secured.

2. Apparatus according to claim 1, including thread guiding bails (32) secured (31) to the machine, said thread guiding bails being located above the thread guide means (1), located in a plane approximately parallel to the threads, and oriented to separate the threads (34*a–d*) passing through the eyes (13) from each other.

3. Apparatus according to claim 2, wherein the thread guiding bails (32) are formed as vertically arranged polygonal wire hoops;

and a transverse rod (33) interconnects said polygonal wire hoops, said rod being located at a side of the polygonal wire hoops where the thread passes therebetween.

4. Apparatus according to claim 1, wherein the thread entrainment element (27) is secured to the cylinder bed (10) of the knitting machine, the segment (28) being located at a height to be below the lower edge of the dial needle contour, when the dial needles project from the dial bed of the machine.

5. Apparatus according to claim 1, wherein the thread entrainment element (27) comprises a base portion (35) angularly interconnected with the thread entrainment segment (28);

and means (36) securing said base portion (35) to one of the needle beds of the knitting machine.

6. Apparatus according to claim 1, wherein the thread entrainment element (FIGS. 5, 6: 27*a*) comprises a thread directing portion (50) located adjacent the thread entrainment segment (28*a*), said thread directing portion terminating with an edge (52) facing the inclined guide surface (28*a*) and spaced therefrom to form a thread entrainment slit (51) therewith.

7. Apparatus according to claim 6, wherein the thread entrainment element comprises a base portion (53, 56) angularly interconnected with the thread entrainment segment (28*a*) and the thread directing portion (50);

and an elongated opening (54) extending essentially parallel to the intersection of the thread entrainment segment (28) and the thread directing portion (50) with the base portion formed in said thread entrainment element, said opening (54) communicating with said entrainment slit (51).

8. Apparatus according to claim 6, wherein the thread directing portion, in plan view, is essentially triangular.

9. Apparatus according to claim 6, wherein the slit (51) extends at an angle, or inclination with respect to the circumference of the respective needle bed to which the element is secured.

10. Apparatus according to claim 1, whrein the guide surface (29) is curved.

11. Apparatus according to claim 1, wherein the guide surface (29*a*) is straight and extends at an inclination with respect to the circumference of the needle bed to which the element is secured.

12. Apparatus according to claim 6, wherein the thread entrainment element comprises a base portion (53, 56) angularly interconnected with the thread entrainment element (28*a*);

and an opening (54) is formed in said base portion adjacent the junction thereof with said thread entrainment segment (28*a*) and the thread directing portion (50), said opening (54) communicating with said slit (51).

13. Apparatus according to claim 1, further comprising a thin needle or pin-like projection (55) extending from the thread entrainment segment (28*a*) and at the side remote from the respective needle bed, one side surface of said pin or needle-like projection forming a continuation of the guide surface (29, 29*a*).

14. Apparatus according to claim 13, wherein said needle or pin-like projection comprises a discrete element of the thread entrainment segment (28*a*) and is soft-soldered thereto.

15. Apparatus according to claim 6, wherein the thread entrainment element (27*a*) comprises a base portion (53, 56) angularly interconnected with the thread entrainment segment (28*a*) and said thread directing portion (50), the thread directing portion (50) extending from and projecting over the base portion (53) in the region of the slit (51).

* * * * *